US008701398B2

(12) United States Patent
Baseley et al.

(10) Patent No.: US 8,701,398 B2
(45) Date of Patent: Apr. 22, 2014

(54) STRAIN ENERGY ACCUMULATOR

(75) Inventors: Simon J. Baseley, Ann Arbor, MI (US); William P. Donohue, Milford, MI (US)

(73) Assignee: Robert Bosch GmbH, Stuttgart (DE)

( * ) Notice: Subject to any disclaimer, the term of this patent is extended or adjusted under 35 U.S.C. 154(b) by 141 days.

(21) Appl. No.: 13/424,585

(22) Filed: Mar. 20, 2012

(65) Prior Publication Data

US 2013/0247751 A1 Sep. 26, 2013

(51) Int. Cl.
*F15B 21/14* (2006.01)
*F15B 1/04* (2006.01)

(52) U.S. Cl.
USPC ..... 60/414; 60/416; 138/30

(58) Field of Classification Search
CPC ..... F15B 21/14; F15B 2201/3158; F15B 2201/32
USPC ..... 60/414, 416; 138/30
See application file for complete search history.

(56) References Cited

U.S. PATENT DOCUMENTS

| | | | | |
|---|---|---|---|---|
| 224,370 | A | 2/1880 | Wilson | |
| 435,927 | A | 9/1890 | Ginty | |
| 2,497,491 | A | 2/1950 | Douglas | |
| 2,642,091 | A | 6/1953 | Morin | |
| 2,760,518 | A | 8/1956 | Peet | |
| 3,091,258 | A | 5/1963 | Marette | |
| 3,162,213 | A | 12/1964 | Peters | |
| 3,163,985 | A * | 1/1965 | Bouyoucos | 60/416 |
| 3,276,477 | A | 10/1966 | Bleasdale | |
| 3,442,292 | A | 5/1969 | Jacuzzi | |
| 3,461,914 | A | 8/1969 | Sugimura et al. | |
| 3,481,254 | A | 12/1969 | Wetherbee, Jr. | |
| 3,493,001 | A | 2/1970 | Bevandich | |
| 3,625,242 | A * | 12/1971 | Ostwald | 138/30 |
| 3,665,967 | A | 5/1972 | Kachnik | |
| 3,788,358 | A | 1/1974 | Taki | |

(Continued)

FOREIGN PATENT DOCUMENTS

| | | |
|---|---|---|
| DE | 3941904 | 6/1991 |
| DE | 102005029527 | 2/2006 |

(Continued)

OTHER PUBLICATIONS

Li, Perry, Research to Increase Fluid Power Energy Storage Density, newsletter, Aug. 2009, p. 7, Center for Compact and Efficient Fluid Power.

(Continued)

*Primary Examiner* — F. Daniel Lopez
(74) *Attorney, Agent, or Firm* — Michael Best & Freidrich LLP

(57) ABSTRACT

An expandable accumulator and reservoir assembly includes a housing defining an interior chamber configured to contain a working fluid therein. An expandable accumulator is positioned at least partially within the housing. The expandable accumulator includes at least one flexible member configured to be at least partially immersed in the working fluid contained within the interior chamber. A rigid support member is positioned in the interior chamber and outside of the expandable accumulator. The rigid support member has at least one aperture to allow passage of the working fluid. An additional flexible member is positioned outside the rigid support member and has perimeter portions sealed to the outside of the rigid support member. The additional flexible member defines a flexible boundary between a primary reservoir inside the additional flexible member and a separate secondary reservoir outside the additional flexible member.

19 Claims, 3 Drawing Sheets

(56) References Cited

U.S. PATENT DOCUMENTS

| | | | | |
|---|---|---|---|---|
| 3,847,182 | A | 11/1974 | Greer | |
| 3,907,000 | A | 9/1975 | Carr | |
| 3,951,143 | A | 4/1976 | Kitrilakis et al. | |
| 3,993,069 | A | 11/1976 | Buckles et al. | |
| 4,091,393 | A | 5/1978 | Masuyama et al. | |
| 4,162,692 | A | 7/1979 | Greer et al. | |
| 4,273,160 | A | 6/1981 | Lowles | |
| 4,351,409 | A | 9/1982 | Malik | |
| 4,367,786 | A | 1/1983 | Hafner et al. | |
| 4,386,601 | A | 6/1983 | Trick | |
| 4,417,567 | A | 11/1983 | Trick | |
| 4,432,393 | A * | 2/1984 | Mills | 138/30 |
| 4,651,781 | A | 3/1987 | Kandelman | |
| 4,732,176 | A | 3/1988 | Sugimura | |
| 4,751,869 | A | 6/1988 | Paynter | |
| 5,067,390 | A | 11/1991 | Negishi | |
| 5,246,761 | A | 9/1993 | Sasaki | |
| 5,351,602 | A | 10/1994 | Monroe | |
| 5,380,074 | A | 1/1995 | Jones | |
| 5,732,741 | A | 3/1998 | Shiery | |
| 5,735,313 | A | 4/1998 | Jenski, Jr. et al. | |
| 5,860,452 | A | 1/1999 | Ellis | |
| 5,937,732 | A | 8/1999 | Homann | |
| 6,076,557 | A | 6/2000 | Carney | |
| 6,131,613 | A | 10/2000 | Jenski, Jr. et al. | |
| 6,146,114 | A | 11/2000 | Nardacci et al. | |
| 6,247,763 | B1 | 6/2001 | Rehn et al. | |
| 6,389,868 | B2 | 5/2002 | Nagao et al. | |
| 6,460,571 | B1 | 10/2002 | Rajabi et al. | |
| 6,666,127 | B2 | 12/2003 | Peles | |
| 6,868,773 | B2 | 3/2005 | Davis et al. | |
| 6,948,479 | B1 | 9/2005 | Raney et al. | |
| 7,107,767 | B2 * | 9/2006 | Frazer et al. | 60/414 |
| 7,108,016 | B2 | 9/2006 | Moskalik et al. | |
| 7,306,006 | B1 * | 12/2007 | Cornell | 138/30 |
| 7,526,918 | B2 | 5/2009 | Hall et al. | |
| 7,540,958 | B2 | 6/2009 | Chevallet et al. | |
| 7,600,376 | B2 | 10/2009 | Hall et al. | |
| 7,637,285 | B2 | 12/2009 | Weber | |
| 7,677,036 | B2 | 3/2010 | Hall et al. | |
| 7,762,364 | B2 | 7/2010 | Hall et al. | |
| 8,020,587 | B2 | 9/2011 | Gray, Jr. | |
| 2003/0000588 | A1 | 1/2003 | Kuykendal et al. | |
| 2004/0144437 | A1 | 7/2004 | Kaltsounis et al. | |
| 2005/0020870 | A1 | 1/2005 | Suzuki et al. | |
| 2007/0025890 | A1 | 2/2007 | Joshi et al. | |
| 2007/0077463 | A1 | 4/2007 | Adams et al. | |
| 2008/0308168 | A1 | 12/2008 | O'Brien, II et al. | |
| 2009/0007554 | A1 | 1/2009 | Hall et al. | |
| 2009/0007980 | A1 | 1/2009 | Hall et al. | |
| 2009/0008171 | A1 | 1/2009 | Hall et al. | |
| 2009/0008918 | A1 | 1/2009 | Hall et al. | |
| 2011/0079140 | A1 | 4/2011 | Baseley | |
| 2012/0211112 | A1 * | 8/2012 | Barth et al. | 138/30 |

FOREIGN PATENT DOCUMENTS

| | | |
|---|---|---|
| EP | 0197911 | 10/1986 |
| JP | 51-53604 | 5/1976 |
| JP | 62196401 | 8/1987 |
| JP | 5229076 | 9/1993 |
| WO | 2008013685 | 1/2008 |
| WO | 2010117853 | 10/2010 |

OTHER PUBLICATIONS

Vanderbilt University, High Energy-Density Hydraulic Accumulator, brochure, Sep. 21, 2009, 1 page, Vanderbilt University Office of Technology Transfer and Enterprise Development.

* cited by examiner

STRAIN ENERGY ACCUMULATOR

BACKGROUND

The present invention relates to strain energy accumulators. A strain energy accumulator may be provided as part of a hydraulic energy storage system with a reversible pump/motor in a vehicle hybrid hydraulic drive system. The hybrid hydraulic drive system absorbs and stores drive energy in the form of a working fluid by pumping the working fluid from a low pressure reservoir into the expandable strain energy accumulator. The hybrid hydraulic drive system provides drive power to the vehicle by using the stored high pressure fluid from the accumulator to operate the pump/motor as a motor. Hybrid hydraulic drive systems can thus add power to or subtract power from a conventional vehicle drive system of the vehicle.

SUMMARY

In one aspect, the invention provides an expandable accumulator and reservoir assembly. The expandable accumulator and reservoir assembly includes a housing defining an interior chamber configured to contain a working fluid therein. An expandable accumulator is positioned at least partially within the housing. The expandable accumulator includes at least one flexible member configured to be at least partially immersed in the working fluid contained within the interior chamber. A rigid support member is positioned in the interior chamber and outside of the expandable accumulator. The rigid support member has at least one aperture to allow passage of the working fluid. An additional flexible member is positioned outside the rigid support member and has perimeter portions sealed to the outside of the rigid support member. The additional flexible member defines a flexible boundary between a primary reservoir inside the additional flexible member and a separate secondary reservoir outside the additional flexible member.

In another aspect, the invention provides an energy storage system. The energy storage system includes a reversible pump/motor having a first inlet/outlet and a second inlet/outlet, a shaft coupled to the reversible pump/motor, and an expandable accumulator and reservoir assembly. The expandable accumulator and reservoir assembly has a first port in communication with the first inlet/outlet via a first fluid line and a second port in communication with the second inlet/outlet via a second fluid line. The expandable accumulator and reservoir assembly includes a housing defining an interior chamber configured to contain a working fluid therein. An expandable accumulator is positioned at least partially within the housing and includes at least one flexible member configured to be at least partially immersed in the working fluid contained within the interior chamber. An interior of the expandable accumulator is coupled with the first port. A rigid support member is positioned in the interior chamber and outside of the expandable accumulator. The rigid support member has at least one aperture to allow passage of the working fluid. An additional flexible member is positioned outside the rigid support member and has perimeter portions sealed to the outside of the rigid support member. The additional flexible member defines a flexible boundary between a primary reservoir inside the additional flexible member and a secondary reservoir outside the additional flexible member. The second port is in communication with the primary reservoir.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
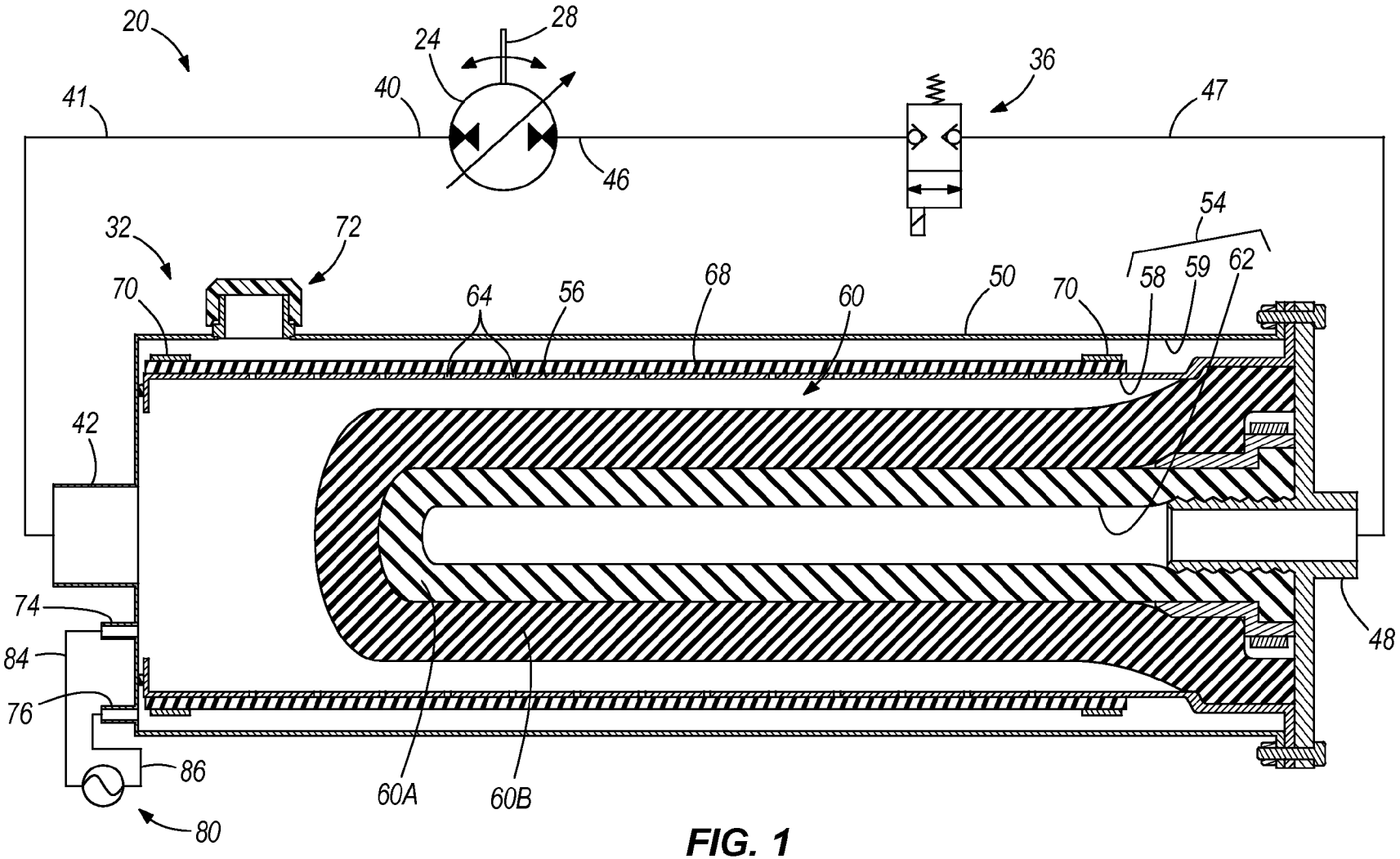
FIG. 1 is a schematic view of an energy storage system, including an accumulator and reservoir assembly illustrated in cross-section.

FIG. 1 illustrates an energy storage system 20 according to one construction of the invention. A reversible pump/motor 24 is provided with an input/output shaft 28, which is rotatable in a first direction under power of the pump/motor 24 when operating as a motor, and is rotatable in a second opposite direction to power the pump/motor 24 to operate as a pump. When operating as a motor, pressurized working fluid (e.g., oil) is supplied to the pump/motor 24 to drive internal pumping elements (not shown) in reverse such that the internal pumping elements drive the shaft 28 in the first direction and the working fluid experiences a pressure drop. When operating as a pump, working fluid at a first pressure is drawn into the pump/motor 24 and pumped to a higher pressure by the internal pumping elements. In either operational mode, the pump/motor 24 communicates working fluid in a closed-loop with an expandable accumulator and reservoir assembly 32 via an isolation valve 36.

The pump/motor 24 includes a first inlet/outlet 40 fluidly coupled with a fluid connection line 41 to a first port 42 of the expandable accumulator and reservoir assembly 32. The pump/motor 24 further includes a second inlet/outlet 46 fluidly coupled with a fluid connection line 47 to a second port 48 of the expandable accumulator and reservoir assembly 32. The isolation valve 36 is positioned along the fluid connection line 47 between the second inlet outlet 46 and the second port 48. The expandable accumulator and reservoir assembly 32 includes a housing 50, which in the illustrated construction takes the form of a generally tubular shell, closed at each end except for the first and second ports 42, 48. The housing 50 defines an interior chamber 54 that contains a quantity of working fluid. However, as described in further detail below, the interior chamber 54 contains additional components that divide the interior chamber 54 into separate portions or sub-chambers.

Figure 2:
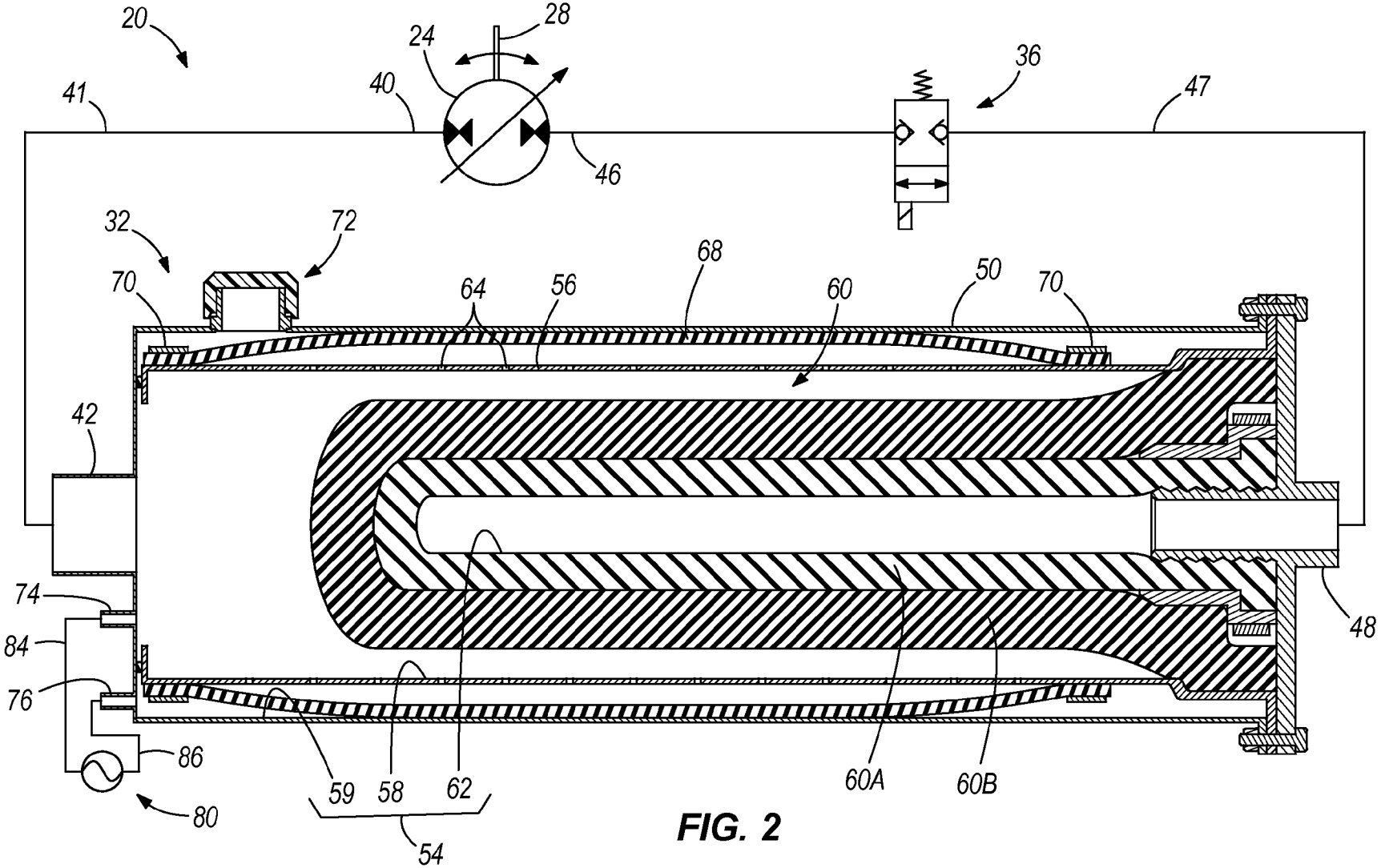
FIG. 2 is a schematic view of the energy storage system of FIG. 1, showing the accumulator and reservoir assembly in a first operational state.

A rigid support member 56 is positioned inside the housing 50. In the illustrated construction, the rigid support member 56 is a generally tubular shell that helps define a boundary between a first chamber or "primary reservoir" 58 on an interior and a second chamber or "secondary reservoir" 59 on an exterior. The primary reservoir 58 is generally cylindrical and the secondary reservoir 59 is generally annular in the illustrated construction. An expandable accumulator 60 is positioned inside the rigid support member 56. The expandable accumulator 60 is secured to at least one of the second port 48 and the rigid support member 56 so that the expandable accumulator 60 defines an expandable accumulator chamber 62 fluidly separated from the primary reservoir 58. The expansion of the accumulator 60 is limited to a predetermined maximum amount by the presence of the rigid support member 56. For example, the expandable accumulator 60 may be spaced from an interior of the rigid support member 56 in a non-pressurized or "at-rest" state as shown in FIGS. 1 and 2, and may expand under internal pressure of the working fluid to contact the interior of the rigid support member 56. The expandable accumulator 60 can be a strain energy accumulator including at least one flexible member surrounded by the rigid support member 56 as shown in the drawings and capable of elastically expanding within the rigid support member 56 when exposed to internal pressure. The expandable accumulator 60 can be a multi-layer bladder similar to one of the teachings of co-assigned U.S. patent application Ser. No. 12/897,442, published as U.S. Patent Application Publication No. 2011/0079140 on Apr. 7, 2011. For example, the expandable accumulator 60 can include multiple dissimilar layers, for example two or more layers 60A, 60B having different stiffness, fracture strain, resistivity to working fluid, etc. Other structures of the expandable accumulator 60 may also be used with the expandable accumulator and reservoir assembly 32 as disclosed herein.

The rigid support member 56 (e.g., the cylindrical wall) includes at least one aperture 64 to allow passage of the working fluid in the primary reservoir 58 through the rigid support member 56. In the illustrated construction, a plurality of apertures 64 are provided in the rigid support member 56. In the illustrated construction, the plurality of apertures 64 are distributed (e.g., evenly) substantially across an entire wall portion of the tube that forms the rigid support member 56. The portion of the rigid support member 56 having the apertures 64 is covered by an additional flexible member 68, which can be constructed of one or more flexible layers. As shown in the drawings, the additional flexible member 68 surrounds the rigid support member 56. In the illustrated construction, the additional flexible member 68 is a tubular sleeve configured to fit over the rigid support member 56 (e.g., either loosely or elastically stretched). Although shown as having a uniform thickness, the additional flexible member 68 can have a reduced thickness over part of its length (e.g., forming a "working section" which inflates or flexes more easily). Perimeter portions of the additional flexible member 68, which in the illustrated construction are the two opposed circular ends of the sleeve, are clamped onto the rigid support member 56 with clamps 70 so that a seal is created therebetween. The additional flexible member 68 thus defines a flexible boundary between the primary reservoir 58 inside the additional flexible member 68 and the secondary reservoir 59 outside the additional flexible member 68. In addition to supporting the additional flexible member 68 to define an at-rest position of the flexible boundary, small portions of the rigid support member 56 that lie outside the clamps 70 also define fixed boundary portions between the primary and secondary reservoirs 58, 59. In other constructions, substantially the entire boundary between the primary and secondary reservoirs 58, 59 is defined by the additional flexible member 68. A fill port 72 in the housing 50 provides selective access to the secondary reservoir 59.

Additional ports 74, 76 in the housing are provided to enable selective fluid communication between the primary and secondary reservoirs 58, 59. The ports 74, 76 are in respective fluid communication with the primary and secondary reservoirs 58, 59 and are coupled together by a fluid passage including a pump 80. In the illustrated construction, the ports 74, 76 are coupled to the pump 80 with respective fluid lines 84, 86 on the outside of the housing 50. If desired, the pump 80 could be provided inside the housing 50 with an internal fluid passage selectively coupling the primary and secondary reservoirs 58, 59, but this would require an increase in the size of the housing 50, and may introduce additional complexity. As described in further detail below, the pump 80 enables the primary reservoir 58 to be pressurized to at least a nominal pre-charge pressure that is beneficial for pre-charging the reversible pump/motor 24. The pump 80 can be a light-duty electrically-powered hydraulic pump, but other types of pumps may be used.

Figure 3:
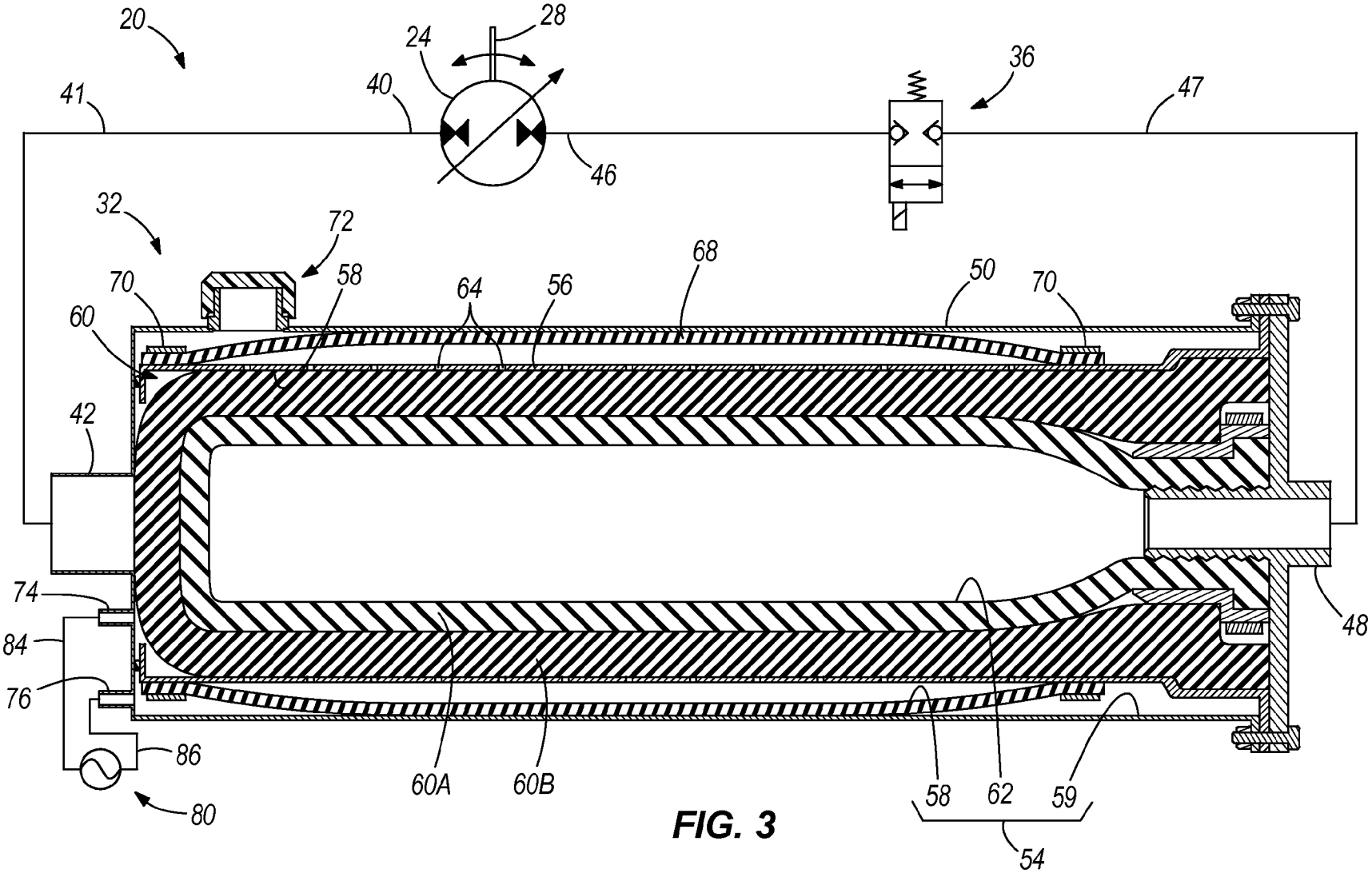
FIG. 3 is a schematic view of the energy storage system of FIG. 1, showing the accumulator and reservoir assembly in a second operational state.

During normal operation of the energy storage system 20, working fluid is moved back and forth between the primary reservoir 58 and the expandable accumulator chamber 62 via the reversible pump/motor 24. For example, the shaft 28 can be coupled to a conventional vehicle drive train to take energy (e.g., during deceleration, coasting) from the vehicle drive train and store the energy as a quantity of pressurized working fluid (FIG. 3) and to subsequently provide drive power to the vehicle by using the stored energy (e.g., adding to or replacing power normally provided by the conventional drive train) by operating the reversible pump/motor 24 as a motor with the stored pressurized working fluid. The amount of working fluid in the system 20 is kept substantially constant throughout normal operation. However, circumstances may arise that can lead to undesirable cavitation and excess noise when using the pump/motor 24 to pump fluid from the primary reservoir 58 to the expandable accumulator chamber 62. For example, "de-aeration" operations, minor leakage, and maintenance can each potentially cause small quantities of working fluid to be lost. To ensure that cavitation and excess noise are minimized or eliminated, the pump 80 is operated to draw working fluid from the secondary reservoir 59 into the primary reservoir 58, at least partially inflating the additional flexible member 68 as shown in FIG. 2 and creating a positive pre-charge pressure of the working fluid in the primary reservoir 58 as the additional flexible member 68 accommodates some minor volume change between the primary and secondary reservoirs 58, 59. The pre-charge pressure can be generated and maintained at about 2 bar or more. In some constructions, the pre-charge pressure is generated and maintained between about 2 bar and about 15 bar, or more particularly between about 3 bar and about 10 bar, and even more particularly between about 3 bar and about 5 bar. The appropriate pre-charge pressure depends upon factors such as the application and the type of main drive pump used. Also, pressure loss due to long inlet lines and high oil viscosity during cold operation can increase the required pre-charge pressure. However, it should be noted that some applications, such as non-hybrid (fully-hydraulic) vehicles using closed systems may maintain a pre-charge pressure in excess of 15 bar. The working fluid in the secondary reservoir 59 remains at approximately atmospheric pressure throughout operation of the energy storage system 20 since the only fluid connection between the secondary reservoir 59 and the primary reservoir 58 is through the pump 80, and no fluid connection is provided between the secondary reservoir 59 and the expandable accumulator chamber 62 within the expandable accumulator and reservoir assembly 32.

The pump 80 can be operated intermittently in response to a measured value of the pressure of the working fluid within the primary reservoir 58 (e.g., measured by a pressure sensor in the primary reservoir 58 and coupled to a controller that controls operation of the pump 80). In other constructions or modes of operation, the pump 80 can be operated continuously during operation of the energy storage system 20, with the pre-charge pressure being limited to a maximum value by a relief valve (not shown). The pump 80 can also be operated to fill or replenish the system 20 with working fluid, either upon initial use or after working fluid lost from the system 20. Utilizing the pump 80, the pre-charge pressure can be varied depending on one or more system parameters including but not limited to temperature of the working fluid, ambient temperature, speed of the reversible pump/motor 24, and speed of a vehicle having the system 20.

Although some aspects of the invention are described above as having particular benefit when used in hybrid hydraulic vehicles, it should be understood that the invention is not limited to such applications.

Various features and advantages of the invention are set forth in the following claims.

What is claimed is:

1. An expandable accumulator and reservoir assembly comprising:

a housing defining an interior chamber configured to contain a working fluid therein;

an expandable accumulator positioned at least partially within the housing, the expandable accumulator including at least one flexible member configured to be at least partially immersed in the working fluid contained within the interior chamber;

a rigid support member positioned in the interior chamber and outside of the expandable accumulator to surround the at least one flexible member, wherein the rigid support member has at least one aperture to allow passage of the working fluid; and an additional flexible member positioned outside the rigid support member to surround the rigid support member, the additional flexible member having perimeter portions sealed to the outside of the rigid support member, the additional flexible member defining a flexible boundary between a primary reservoir inside the additional flexible member and a separate secondary reservoir outside the additional flexible member.

2. The expandable accumulator and reservoir assembly of claim 1, further comprising a first port in communication with an interior of the expandable accumulator and a second port in communication with the primary reservoir, and the first and second ports are configured to exchange working fluid between the expandable accumulator and the primary reservoir through at least one fluid line outside the housing.

3. The expandable accumulator and reservoir assembly of claim 2, further comprising a third port in communication with the primary reservoir and a fourth port in communication with the secondary reservoir, wherein at least one additional fluid line outside the housing is configured to fluidly couple the third and fourth ports.

4. The expandable accumulator and reservoir assembly of claim 3, further comprising a pump positioned along the at least one additional fluid line between the third and fourth ports, the pump configured to maintain a positive pre-charge pressure in the primary reservoir.

5. The expandable accumulator and reservoir assembly of claim 4, wherein the pump is configured to maintain a positive pre-charge pressure between about 2 bar and about 15 bar.

6. The expandable accumulator and reservoir assembly of claim 1, further comprising a fill port in the housing, the fill port being in communication with the secondary reservoir.

7. The expandable accumulator and reservoir assembly of claim 1, wherein the rigid support member is a tube, and the additional flexible member is a sleeve extending around the tube and sealed to the tube at first and second opposing ends of the sleeve.

8. The expandable accumulator and reservoir assembly of claim 7, wherein the tube includes an array of apertures distributed substantially across an entire wall portion of the tube that is covered by the sleeve.

9. The expandable accumulator and reservoir assembly of claim 7, further comprising a first circular clamp positioned at the first end of the sleeve and a second circular clamp positioned at the second end of the sleeve, the first and second circular clamps engaging upon the sleeve to seal the first and second ends of the sleeve to the tube.

10. The expandable accumulator and reservoir assembly of claim 1, wherein the at least one flexible member of the expandable accumulator includes two dissimilar layers.

11. An energy storage system comprising:

a reversible pump/motor having a first inlet/outlet and a second inlet/outlet;

a shaft coupled to the reversible pump/motor; and an expandable accumulator and reservoir assembly having a first port in communication with the first inlet/outlet via a first fluid line and a second port in communication with the second inlet/outlet via a second fluid line, the expandable accumulator and reservoir assembly including a housing defining an interior chamber configured to contain a working fluid therein, an expandable accumulator positioned at least partially within the housing, the expandable accumulator including at least one flexible member configured to be at least partially immersed in the working fluid contained within the interior chamber, wherein an interior of the expandable accumulator is coupled with the first port, a rigid support member positioned in the interior chamber and outside of the expandable accumulator to surround the at least one flexible member, wherein the rigid support member has at least one aperture to allow passage of the working fluid, and an additional flexible member positioned outside the rigid support member to surround the rigid support member, the additional flexible member having perimeter portions sealed to the outside of the rigid support member, the additional flexible member defining a flexible boundary between a primary reservoir inside the additional flexible member and a secondary reservoir outside the additional flexible member, wherein the second port is in communication with the primary reservoir.

12. The energy storage system of claim 11, wherein the expandable accumulator and reservoir assembly further comprises a third port in communication with the primary reservoir, a fourth port in communication with the secondary reservoir, and a fluid passage coupling the third and fourth ports.

13. The energy storage system of claim 12, further comprising a pump positioned along the fluid passage between the third and fourth ports, the pump configured to maintain a positive pre-charge pressure in the primary reservoir.

14. The energy storage system of claim 13, wherein the pump is configured to maintain a positive pre-charge pressure between about 2 bar and about 15 bar.

15. The energy storage system of claim 11, further comprising a fill port in the housing, the fill port being in communication with the secondary reservoir.

16. The energy storage system of claim 11, wherein the rigid support member is a tube, and the additional flexible member is a sleeve extending around the tube and sealed to the tube at first and second opposing ends of the sleeve.

17. The energy storage system of claim 16, wherein the tube includes an array of apertures distributed across substantially an entire wall portion of the tube that is covered by the sleeve.

18. The energy storage system of claim 16, further comprising a first circular clamp positioned at the first end of the sleeve and a second circular clamp positioned at the second end of the sleeve, the first and second circular clamps engaging upon the sleeve to seal the first and second ends of the sleeve to the tube.

19. The expandable accumulator and reservoir assembly of claim 11, wherein the at least one flexible member of the expandable accumulator includes two dissimilar layers.

* * * * *